US006903689B2

(12) United States Patent
Apostolos et al.

(10) Patent No.: US 6,903,689 B2
(45) Date of Patent: Jun. 7, 2005

(54) HEMISPHERICAL MEANDER LINE LOADED ANTENNA

(75) Inventors: John T. Apostolos, Merrimack, NH (US); Patrick D. McKivergan, Londonderry, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 28 days.

(21) Appl. No.: 10/705,703

(22) Filed: Nov. 11, 2003

(65) Prior Publication Data

US 2005/0099336 A1 May 12, 2005

(51) Int. Cl.[7] ..... H01Q 1/38
(52) U.S. Cl. ..... 343/700 MS; 343/872
(58) Field of Search ..... 343/700 MS, 702, 343/793, 795, 846, 872, 895

(56) References Cited

U.S. PATENT DOCUMENTS 5,790,080 A 8/1998 Apostolos
5,936,584 A * 8/1999 Lawrence et al. ..... 343/702
6,115,003 A * 9/2000 Kozakoff ..... 343/840
6,313,716 B1 11/2001 Apostolos
6,323,814 B1 11/2001 Apostolos
6,373,440 B2 4/2002 Apostolos
6,373,446 B2 4/2002 Apostolos
6,404,391 B1 6/2002 Apostolos
6,480,158 B2 11/2002 Apostolos
6,492,953 B2 12/2002 Apostolos
6,504,508 B2 * 1/2003 Apostolos ..... 343/700 MS
6,590,543 B1 7/2003 Apostolos
6,597,321 B2 * 7/2003 Thursby et al. ..... 343/744
6,686,872 B2 * 2/2004 Vacanti ..... 342/173
6,741,212 B2 * 5/2004 Kralovec et al. .... 343/700 MS

* cited by examiner

*Primary Examiner*—Tho Phan
(74) *Attorney, Agent, or Firm*—Daniel J. Long; Robert K. Tendler

(57) ABSTRACT

A hemispherical meander line loaded antenna is provided which can fit within a hemispherical radome as to minimize real estate on an aircraft such as an unmanned airborne vehicle. In one embodiment, a double monopole is recreated in a hemispherical form, thus to make what was originally a rectilinear package into a hemispherical package without materially affecting VSWR or ultra-wideband and antenna pattern characteristics. The wideband double monopole hemispherical meander line loaded antenna is provided with a single feed, with the delay associated with the meander lines equalize the reactance of the antenna, thereby to enable proper impedance matching.

13 Claims, 3 Drawing Sheets

HEMISPHERICAL MEANDER LINE LOADED ANTENNA

FIELD OF THE INVENTION

This invention relates to meander line loaded antennas and more particularly to a hemispherical version thereof.

BACKGROUND OF THE INVENTION

While meander line loaded antennas are known and are exemplified by U.S. Pat. Nos. 5,790,080; 6,313,716; 6,323,814; 6,373,440; 6,373,446; 6,480,158; 6,492,953; and 6,404,391, assigned to the assignee hereof and included herein by reference, there is a necessity for locating a wide bandwidth double monopole meander line loaded antenna in a radome especially on an unmanned airborne vehicle for use in communication and surveillance. Typically, the radomes on such aircraft are designed with a 30-inch diameter, making it somewhat difficult to locate a standard rectilinear meander line loaded antenna in such a restricted space.

As can be seen in U.S. Pat. No. 6,590,543 a double monopole meander line loaded antenna has a vertical radiator connected by meander lines to orthogonally-oriented radiators which extend horizontally in either direction from the top of the vertical radiator. In all of the prior meander line loaded antennas there is a right angle between the horizontal and vertical radiators such that the top plate is always parallel to the ground plane plate utilized. This parallel plate configuration optimizes the current distribution for maximum bandwidth. It will be appreciated that with rectilinear double monopole meander line loaded antennas, the spacing between the top plate and the ground plane plate is invariant. Because of this, the height of the horizontal plates above the ground plane plate limits the ability to place such an antenna in a small radome without reducing the overall size and volume of the antenna. Such a reduction in size limits the ultra-wideband characteristic of the antenna because the low frequency cutoff is raised.

SUMMARY OF INVENTION

It has been found that the top plates, rather than being flat and parallel to the bottom ground plane plate, can be formed in an arc so as to present a hemispherical surface. The hemispherical surface is bifurcated into two semi-hemispherical elements with a vertically-extending radiator which projects between the two halves. When this vertically extending radiator is connected by meander lines to the bifurcated sections of the hemisphere, the connection is at right angles at that point. Thus, the 90° relationship is maintained in the region where the vertical radiator is coupled to the semi-hemispherical elements. What has been found is that one can curve the ends of the top plate downwardly towards the ground plane plate with very little degradation of the antenna pattern, very little change in VSWR and only negligible changes in the ultrawide bandwidth operation.

In one embodiment, the antenna is formed by taking a hemisphere of Styrofoam and coating or providing conductive layers on top of the hemispheric Styrofoam to provide the bifurcated top plate. The internal vertical radiator in one embodiment is of a fan shape with the feed point being at the apex of the fan. The opposed arcuate top edge of the fan corresponds in curvature to the curvature of the semi-hemispherical conductive elements. The top point in the arc is connected to the opposed semi-hemispherical elements by respective meander lines to form a double monopole meander line loaded antenna While Styrofoam has been utilized for the formation of the bifurcated hemisphere it is possible to make the bifurcated hemisphere of rigid metal or by utilizing the radome itself, which is an electrical insulator. In this case, a bifurcated conductive layer is patterned onto the interior surface of the radome.

The vertical rising fan-shaped radiator rises up from the base of the radome to the deposited layers, with the meander lines running from the center of the arcuate top edge of the vertical radiator to the deposited metallization.

In operation, the antenna has an ultrawide bandwidth extending from 30 megahertz to 200 megahertz for surveillance purposes, such that a wide range of frequencies can be swept. Moreover, the antenna, in addition to surveillance capabilities, can be used for communications purposes due to its unusual gain in which the VSWR is less than 1.5:1 across the entire bandwidth.

While it is tolerable to have less efficient receive antennas for surveillance purposes, in order to fabricate an efficient transmit antenna for communications purposes in a small, compact area, it is exceedingly important that the VSWR be carefully controlled to be less than 2:1 across the entire operational band. Note that for overflying aircraft, a downwardly-pointing monopole antenna pattern is desirable and this pattern is exactly what the hemispherical double meander line loaded antenna delivers.

In summary, it is only with difficulty that one can design a communications antenna that is small enough to be compactly mounted within a small radome with the appropriate monopole antenna pattern. Standard meander line loaded antenna configurations are rectilinear in configuration and thus have height problems, meaning that for equivalent wideband operation the radome would have to be considerably larger. The size of such a radome might preclude its use on unmanned airborne vehicles, or UAVs.

On the other hand, the subject hemispherical antenna is so compact that it has unique application for unmanned aircraft, as well as for manned aircraft where fuselage space is at a premium. Note that when one has UAVs serving as communications nodes, with the appropriate antenna these UAVs can take the place of satellites. Thus, for UAVs flying at over 70,000 feet, these vehicles can provide communications over a wide area, and can duplicate the coverage offered by satellites over a given area. The important consideration is that these systems be operable in the 30 megahertz to 88 megahertz communication bands. Thus, with one's UAVs flying at the heights noted above, one can establish communication with a large number of ground troops and land-based vehicles in a wide theater of action without having to worry about satellite coverage, satellite transmit power or satellite capacity.

It will be appreciated that because the subject antenna is so efficient, one needs to run less power to maintain communications and the UAV can stay aloft for a relatively long period of time.

In comparing the subject antenna to a typical blade antenna with the same height, i.e., 24 inches, the gain of the blade antenna at 30 MHz has been measured to be −21 dBi. On the other hand, the gain of the subject antenna at 30 MHz is −5 dBi, a gain of 16 dBi over the blade antennas and 40 times the gain of a blade antenna. It will be appreciated that blade antennas are utilized for their aerodynamic configuration such that when they are mounted on an aircraft they act as a vertical fin or stabilizer. However, because the gain of these antennas is so poor, transmit power must be increased to establish reliable communications. On the other hand, when using the subject antenna, one needs to radiate 40 times less power than the blade antenna for the same communications efficiency, making it possible for the UAV to stay aloft longer.

Moreover, if one were to take the double monopole meander line loaded antenna of U.S. Pat. No. 6,590,543 and locate it in a standard radome, one would typically lose 5 to 7 dBi in performance because the volume of the antenna would have to be smaller. With the double monopole meander line loaded antenna in a hemispherical form, one regains the lost 7 dBi.

In summary, a hemispherical meander line loaded antenna is provided which can fit within a hemispherical radome so as to minimize real estate on an aircraft such as an unmanned airborne vehicle. In one embodiment, a double monopole is recreated in a hemispherical form, thus to make what was originally a rectilinear package into a hemispherical package without materially affecting VSWR or ultra-wideband and antenna pattern characteristics. The wideband double monopole hemispherical meander line loaded antenna is provided with a single feed, with the delay associated with the meander lines of the antenna adjusted to equalize the reactance of the antenna, thereby to enable proper impedance matching.

BRIEF DESCRIPTION OF THE DRAWINGS

These and other features of the subject invention will be better understood in connection with a Detailed Description, in conjunction with the Drawings, of which.

DETAILED DESCRIPTION

Figure 1:
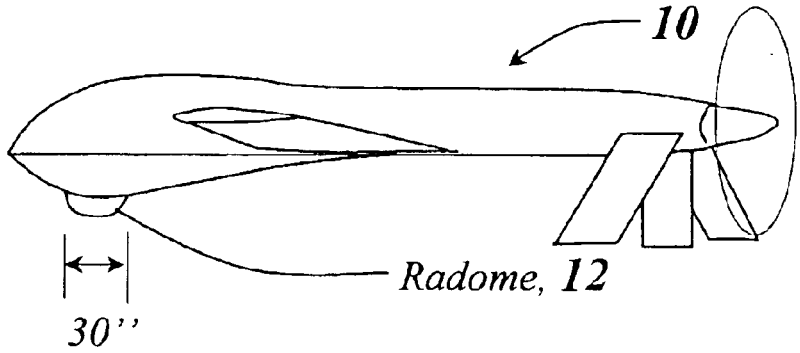
FIG. 1 is a diagrammatic illustration of a UAV provided with a 30-inch radome on its belly, with the radome to house a communications antenna for wide bandwidth communications.

Referring now to FIG. 1, an unmanned airborne vehicle 10 such as a Global Hawk is provided with a radome 12 at the underside of its fuselage, with the radome intended to house a communications antenna covering, for instance, a communications band between 30 MHz and 88 MHz. The ultra-wideband antenna suitable for such an operation, which may include a high frequency cutoff as high as one gigahertz, has in the past been implemented with rectilinear meander line loaded antenna structures.

As mentioned hereinbefore, in order to obtain a low frequency cutoff as low as 30 MHz and sometimes as low as 20 MHz, the amount of volume of the standard meander line loaded antenna cannot be decreased. Note that the volume of the meander line loaded antenna is determined by its top plate. To maintain the low frequency cutoff the top plate cannot be foreshortened. As a result, for a rectilinear meander line loaded antenna operating down to 30 MHz its top plate would extend past the radome. Thus, in order to accommodate an ultra-wideband antenna in such a 30-inch diameter radome, one would have to significantly reduce the top plate of a conventional meander line loaded antenna. Reducing the top plate, however, not only increases the low frequency cutoff but also materially affects the VSWR and the antenna pattern for such an antenna.

In order to provide for an ultra-wideband and communications antenna for a UAV or other application, in the subject invention a hemispherical double monopole meander line loaded antenna is provided.

Figure 2:
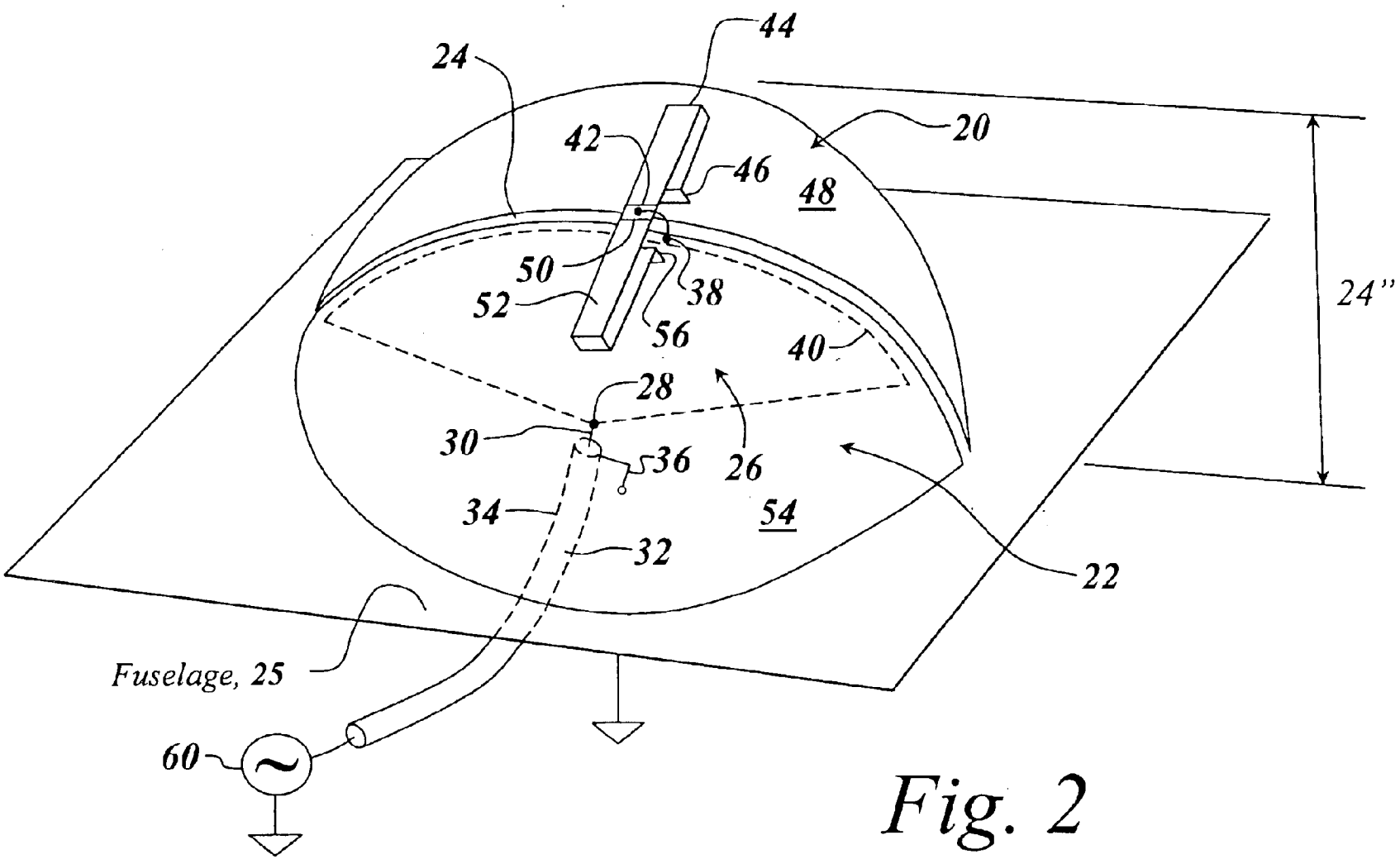
FIG. 2 is a diagrammatic illustration of the subject hemispherical double monopole meander line loaded antenna, illustrating a fan-shaped vertical radiating element connected to the bifurcated halves of the hemispherical-shaped top plate for the antenna in which the fan-shaped vertical radiator is connected to the semi-hemispherical sections via meander lines.

Such an antenna is shown in FIG. 2 to include two semi-hemispherical elements 20 and 22 located in spaced adjacency to a ground plane 25 that in one embodiment is the fuselage of an aircraft. The two semi-hemispherical halves or sections 20 and 22 are spaced apart as illustrated by a slot, notch or channel 24.

The semi-hemispherical elements are fed by a fan-shaped vertically extending radiator shown in dotted outline 26, with the antenna being fed at the apex 28 of the fan-shaped vertical radiator 26 by coupling the center conductor 30 of a coaxial cable 32 to this apex. It is noted that the outer shield 34 of the coaxial cable is grounded to the ground plane plate 25 as illustrated at 36.

In order to couple the vertical radiator to the semi-hemispherical portions or elements, the topmost portion 38 of the arc 40 of the vertical fan-shaped radiator 26 is coupled to an end 42 of a meander line 44 having its other end 46 coupled to semi-hemispherical section 48. A meander line 52 is coupled to point 38 at end 50 and to semi-hemispherical element 54 at its other end 56. The antenna is driven by a signal source 60 as illustrated.

While the semi-hemispherical elements 48 and 54 may be formed by continuous formed metal sheets, in one embodiment the antenna is simply fabricated utilizing a Styrofoam core on which are laid conductive layers so as to form the semi-hemispherical elements 48 and 54.

Figure 3:
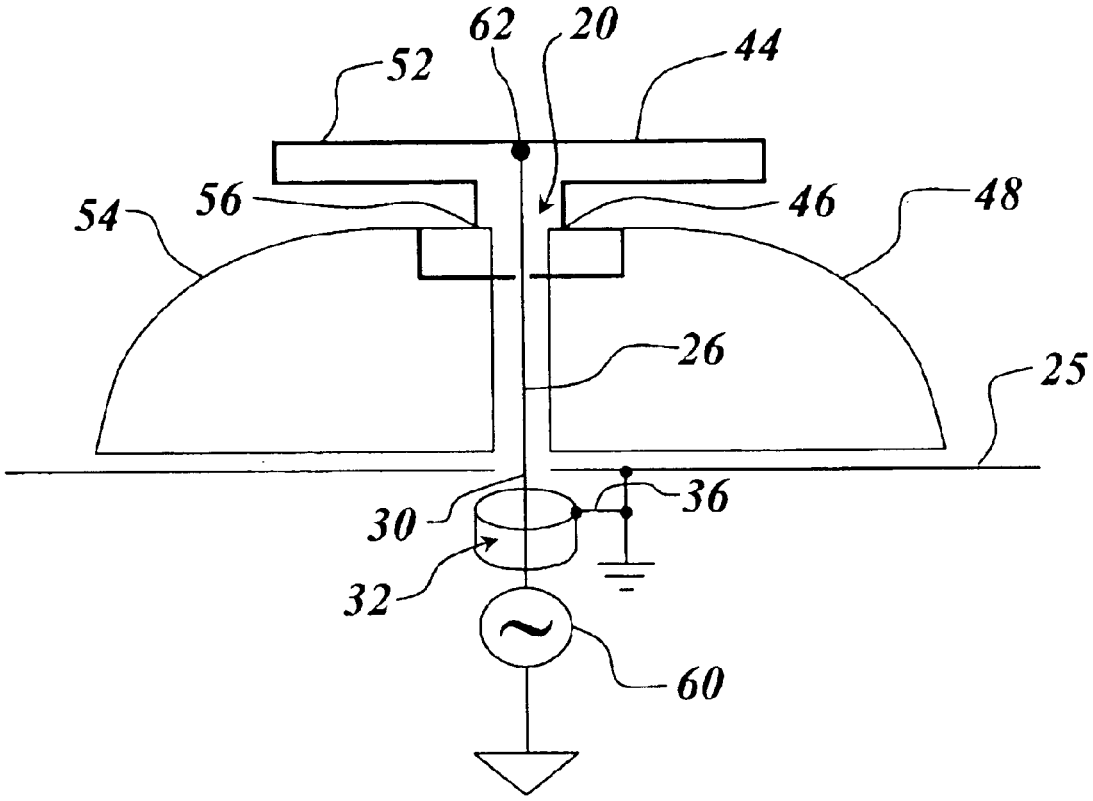
FIG. 3 is a diagrammatic illustration of the hemispherical antenna of FIG. 2, illustrating the vertical radiator connected via double meander lines to respective semi-hemispherical halves of the antenna; and, FIG. 4 is a diagrammatic illustration of an embodiment of the subject invention in which conductive layers are patterned onto the internal surface of a radome, with meander lines connecting a vertical radiating surface to the bifurcated hemispherical patterned layers on the inside surface of the radome.

Referring to FIG. 3, the electrical equivalent circuit is shown in which vertical radiator 26 is shown coupled to meander lines 44 and 52 at point 62, with the other ends of the meander lines, namely ends 46 and 56, being connected to respective semi-hemispherical elements 48 and 54 as illustrated. It will be noted that at slot 24 there is a right angle relationship between the surfaces of elements 48 and 52 adjacent the vertical radiator 26. This right angle relationship preserves, the desirable current density distribution which led in the past to exceptional wideband operation and low VSWR.

What has been found is that by curving the top plane downwardly towards the ground plate, there is very little change in VSWR, antenna pattern, or effect on the ultrawideband operation. One of the reasons it is thought that there is so little difference is that a large portion of the semi-hemispherical plate is substantially perpendicular to the vertical radiator, with the outlying curved-down areas on the semi-hemispherical elements having little effect on the overall performance of the antenna.

Figure 4:
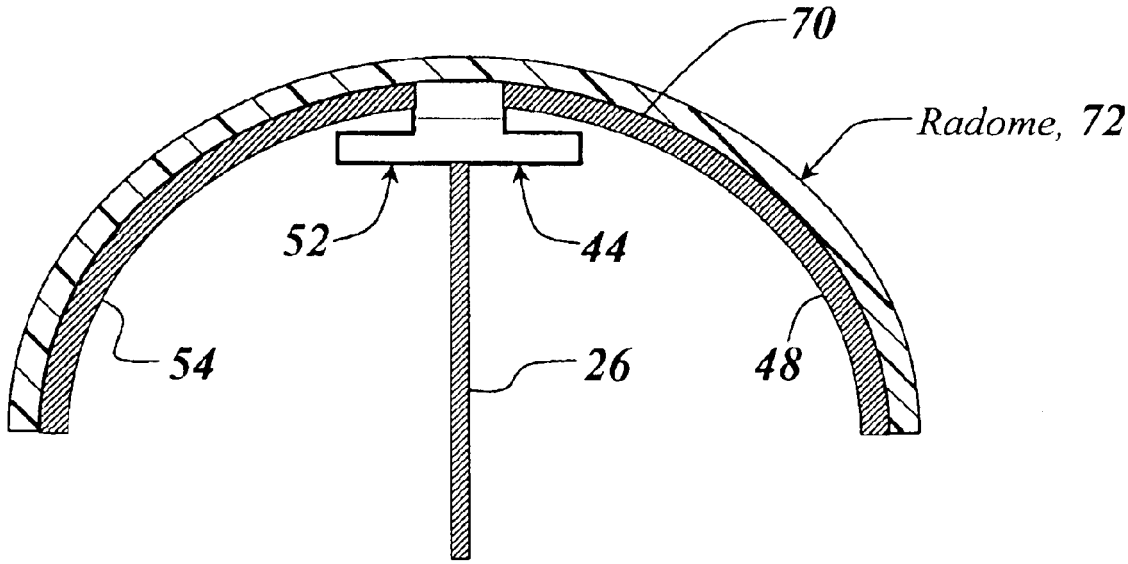

While in FIG. 3 it is shown that the meander lines are connected above the hemispherical surface, as shown in FIG. 4, the semi-hemispherical elements 48 and 54 may be formed on the inside surface 70 of a radome 72 shown to be electrically insulating. Here meander lines 44 and 52 are located interior to radome 72, with the semi-hemispherical elements in one embodiment being conductive layers patterned on the internal surface of the radome.

What will be appreciated is that providing a double monopole in a hemispherical form, its ultra-wideband operation may be maintained. As a result, a reasonably-sized antenna fits easily in a small radome attached to the underbelly or fuselage of unmanned airborne vehicles.

While the present invention has been described in connection with the preferred embodiment of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A hemispherical double monopole meander line loaded antenna.

2. The antenna of claim 1, wherein said antenna includes a bifurcated hemisphere resulting in two adjacent semi-hemispherical elements separated by a slot.

3. The antenna of claim 2, wherein said antenna includes a vertical radiator extending from beneath said semi-hemispherical elements to the vicinity of said slot.

4. The antenna of claim 3, wherein said antenna includes meander lines connected between said vertical radiator and respective semi-hemispherical elements.

5. The antenna of claim 3, wherein said vertical radiator is fan-shaped.

6. The antenna of claim 5, wherein said antenna includes meander lines connected between said vertical radiator and respective semi-hemispherical elements.

7. The antenna of claim 5, and further including an antenna feed coupled to the apex of said fan-shaped vertical radiator.

8. The antenna of claim 2, wherein said antenna includes a ground plane spaced from the bottom of said semi-hemispherical elements.

9. A method of providing an ultra-wideband meander line loaded antenna, for us in a radome of limited size, comprising the steps of:

providing a hemispherical double monopole meander line loaded antenna; and, mounting the hemispherical double monopole meander line loaded antenna in the radome.

10. A method of making a double monopole meander line loaded antenna, comprising the steps of:

providing a hemispherical radome;

patterning the interior surface of the radome with a bifurcated layer of conductive material so as to form two semi-hemispherical elements separated by a slot;

providing a vertical radiator forming a top edge at the slot;

connecting a pair of meander lines between the top edge of the vertical radiator and respective semi-hemispherical elements;

locating a ground plane beneath the elements; and, providing an antenna feed between the bottom of the vertical radiator and the ground plane.

11. A method of minimizing the physical extent of a double monopole meander line loaded antenna having a bifurcated top plate and a ground plane plate without materially affecting antenna characteristics, comprising the step of bending the distal ends of the bifurcated top plate towards the ground plane plate.

12. The method of claim 11, wherein the bent bifurcated top plate is arcuate in cross-section.

13. The method of claim 11, wherein the bent bifurcated top plate is in the form of a bifurcated hemisphere.

* * * * *